United States Patent [19]

Levin

[11] 4,232,972

[45] Nov. 11, 1980

[54] METHOD AND APPARATUS FOR MIXING SUBSTANCES

[76] Inventor: Igor A. Levin, ulitsa, 15, korpus 1, kv. 113, Moscow, Petrozavodskaya, U.S.S.R.

[21] Appl. No.: 22,437

[22] Filed: Mar. 21, 1979

[30] Foreign Application Priority Data

Apr. 6, 1978 [SU] U.S.S.R. ..... 2593846

[51] Int. Cl.[3] ..... B01F 11/00

[52] U.S. Cl. ..... 366/108; 366/118; 366/256

[58] Field of Search ..... 366/108, 114, 116, 118, 366/127, 255, 256, 273, DIG. 600; 134/1, 184

[56] References Cited

U.S. PATENT DOCUMENTS

| | | | |
|---|---|---|---|
| 2,976,434 | 3/1961 | Henry | 366/108 X |
| 3,371,233 | 2/1968 | Cook | 366/116 |
| 3,399,869 | 9/1968 | Loria | 366/116 |
| 3,403,245 | 9/1968 | Eaton | 134/1 X |
| 3,633,877 | 1/1972 | Bodine | 366/600 |

*Primary Examiner*—Edward J. McCarthy

*Attorney, Agent, or Firm*—Lackenbach, Lilling & Siegel

[57] ABSTRACT

The method for mixing substances employs a reciprocating movement provided by mechanical impulses. The apparatus for mixing substances comprises a reservoir, a mixing means, a reciprocating movement mechanism of the mixing means, which mechanism includes eddy current electromagnetic inductors coupled to a current source having a storage capacitor, a turn-on sequencer for said inductors, and elements made of electrically conducting material. The invention substantially improves the effectiveness of the mixing operation and provides for increased labor, productivity, and reduces the power requirements needed to drive the apparatus.

20 Claims, 4 Drawing Figures

METHOD AND APPARATUS FOR MIXING SUBSTANCES

FIELD OF THE INVENTION

The invention relates to general-purpose methods and apparatuses for various physical and chemical processes, and more particularly to a method and apparatus for mixing substances.

The method and apparatus of the invention are applicable to the mixing of liquid mixtures, suspensions, loose materials, gas-liquid systems and the like and, therefore, can be widely applicable in chemical, food, pharmaceutical and other diverse industries.

DESCRIPTION OF THE PRIOR ART

Known in the art is a method of mixing substances in a reciprocating movement (cf. the USSR Inventor's Certificate No. 233616, Int. cl. BO1f, 9/18, 1965), which method is achieved by an apparatus comprising a reservoir filled with a substance to be mixed, and a mixer having an even number of discs and performing movements relative to a vertical axis, and a vibration drive provided with a continuously operated electric motor.

A vertical movement of the mixer does not provide, however, an effective mixing of the substances. Moreover, the known method and apparatus requires a considerable amont of power from an external source since the vibration drive operates in a continuous mode.

There is another method of mixing substances in a reciprocating movement (cf. the USSR Inventor's Certificate No. 229,462, Int. cl. BO1f, 9/18, 1966), which method is achieved by an apparatus comprising a reservoir filled with a substance to be mixed and a mixer having of a number of solid and annular discs. The mixer moves along a vertical axis of the reservoir by virtue of vibration-type resonance electric motors mounted on opposite sides of the reservoir and taking power from an external power source operated in a continuous mode.

A vertical movement of the mixer does not provide, however, for an effective mixing of the substances. Moreover, the two motors operating in a continuous mode require considerable power from the external power source.

The prior art also consists of a prototype embodying a method of mixing substances involved in a reciprocating movement (cf. the USSR Inventor's Certificate No. 413,974, Int. cl. BO1f, 9/18, 1971), which method is achieved by an apparatus comprising a reservoir accommodating a mixing means in the form of a perforated disc, and a recirpocating movement mechanism provided with a pneumatic drive.

In this apparatus, the mixing means can move along in a single direction only, which direction is a longitudinal axis of the reservoir, with the result that a low effectiveness of the mixing is attained. The movement of the mixing means is effected by virtue of a compressor operating in a continuous mode so as to deliver the compressed air into a pneumatic drive, thereby resulting in considerable power requirements.

SUMMARY OF THE INVENTION

An object of the invention is to provide a method of and an apparatus for mixing substances, whereby an increased effectiveness of the mixing of substances is attained along with a decrease in the amount of power required from an external power source.

There is disclosed a method of mixing substances which are subject to a reciprocating movement, which method comprises, according to the invention, generating mechanical impulses that provide for said reciprocating movement of substances.

Advantageously, the method comprises generating mechanical impulses that are at right angles to the reciprocating movement of the substances being mixed.

Preferably, the method comprises generating mechanical impulses that are at right angles to the reciprocating movement of the substances being mixed and which occur simultaneously with respective mechanical impulses providing for said reciprocating movement of the substances being mixed.

Advantageously, the method comprises generating mechanical impulses that are at right angles to the reciprocating movement of the substances being mixed and which occur during the spacings between the mechanical inpulses providing for said reciprocating movement of the substances being mixed.

Preferably, the method comprises a sequential generation of the mechanical impulses providing for the reciprocating movement of the substances being mixed and of the mechanical impulses being at right angles to said reciprocating movement of the substances being mixed.

Preferably, the method comprises generating mechanical pulses having a duration ranging from $10^{-5}$ to $10^{-2}$ s, the ratio between the spacing of the mechanical impulses and their duration amounting to a range of 10 to 10,000.

There is disclosed an apparatus for carrying out the a method of mixing substances, comprising a reservoir accommodating a mixing means and a reciprocating movement mechanism of said mixing means, with said mechanism comprising, according to the invention, eddy current electromagnetic inductors disposed in close vicinity to the end walls of the reservoir and coupled to a current source having a storage capacitor, a turn-on sequencer for the eddy current electromagnetic inductors, and elements made of an electrically conductive material and arranged in contact with an electromagnetic inductors.

Preferably, the turn-on sequencer for the eddy current electromagnetic inductors is implemented as two thyristors whose gate electrodes are coupled to a program switch.

Advantageously, the elements are made of an electrically conductive material and they should be disposed between their respective eddy current electromagnetic inductors and corresponding end walls of the reservoir.

Preferably, the end walls of the reservoir constitute respective elements made of an electrically conductive material.

Advantageously, a side wall of the reservoir mounts eddy current electromagnetic inductors which are arranged in a serial connection to one another and are coupled to the current source having the storage capacitor, and said elements made of an electrically conductive material being disposed between the side wall and the electromagnetic inductors.

The method and apparatus of the invention make it possible to increase the efficiency of the process of mixing substances.

The power taken from an external power source is considerably reduced since the storage capacitor stores the electric energy during the spacings between the mechanical impulses.

The power $N_1$ provided by a mechanical impulse is determined by $$N_1 = N_2 \cdot \eta (t+T)/t \quad (1)$$

where $N_2$ is the power provided by an external power source;

$\eta$ is the efficiency of the apparatus;

t is the duration of a mechanical impulse

T is the spacing of the mechanical impulses, $$10 \leqq T/t \leqq 10{,}000.$$

With $t = 1 \cdot 10^{-3}$ s, T = 1 s, and $\eta = 90\%$, the value of $N_2$ is 800 times lower than the value of $N_1$.

BRIEF DESCRIPTION OF THE DRAWINGS

The invention will now be described in more detail, by way of example, with reference to the accompanying drawings, in which.

DESCRIPTION OF THE PREFERRED EMBODIMENTS

Figure 1:
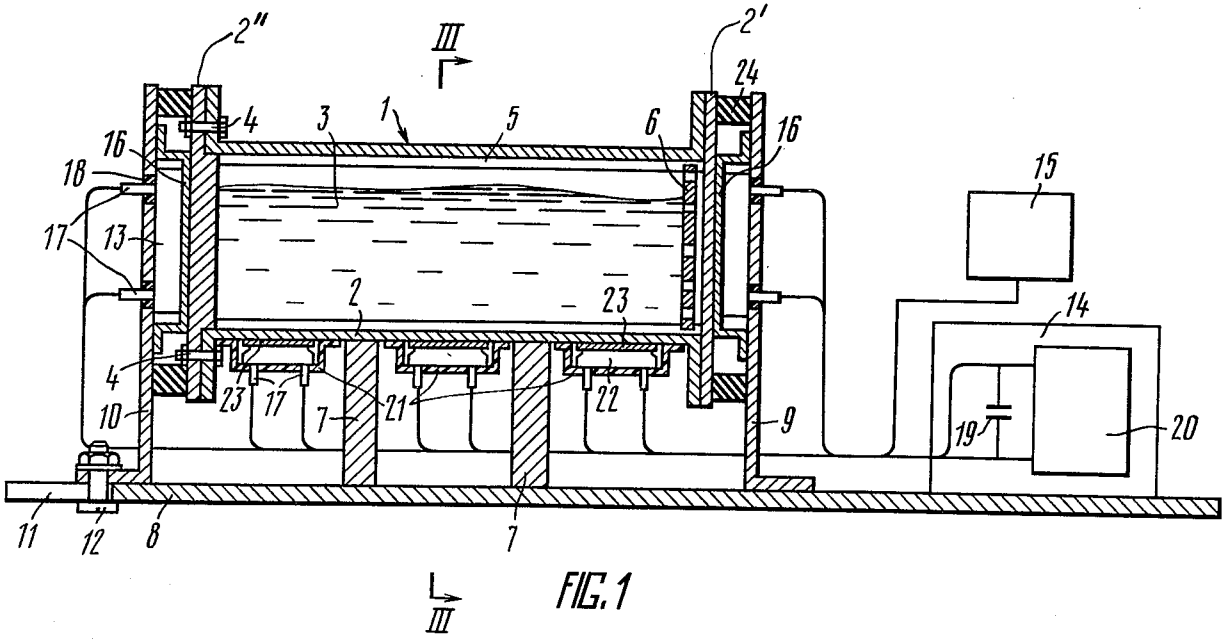
FIG. 1 is a general side elevational view in section of an apparatus for mixing substances, made in accordance with the invention.

A method for mixing substances comprises subjecting them to reciprocating movement, which is achieved by generating mechanical impulses and which improves the effectiveness of the mixing operation. According to the method, a further increase of the effectiveness of the mixing operation occurs by applying to the substances being mixed mechanical impulses which are at right angles to the reciprocating movement of the substances. Concurrent generation of the mechanical impulses responsible for the reciprocating movement of the substances being mixed and of the mechanical impulses that are at right angles to the reciprocating movement enables a reduction in the time required for the mixing operation in the case when the substance viscosity and the dimension of the apparatus dimensions allow for the effective distribution of the energy consumed in generating said mechanical impulses.

It is possible to generate mechanical impulses that are at right angles to the reciprocating movement of the substances being mixed, during the spacings between the mechanical impulses providing for the reciprocating movement, or to generate said two types of the mechanical impulses according to a given sequence.

In those cases when additional mechanical impulses are in a direction which is perpendicular to the reciprocating movement of a substance and are generated during the spacings between those mechanical impulses which provide for the reciprocating movement, the time required for mixing substances is longer than in the alternative modification described hereinabove, whereby additional impulses are generated simultaneously or with the main impulses responsible for providing said reciprocating movement of the substances to be mixed.

The above-mentioned mechanical impulses have a duration ranging from $10^{-5}$ to $10^{-2}$ s, thereby ensuring various operating modes for effective mixing of the substances, the amplitude of a mechanical impulse being inversely related to its duration.

The duration of a mechanical impulse exceeding $10^{-2}$s results in a considerable decrease in the effectiveness of the mixing operation.

The duration of a mechanical impulse less than $10^{-5}$ s requires an apparatus which is difficult to develop and utilize. An optimum ratio of the spacing of mechanical impulses to their duration is in a range from 10 to 10,000, which provides for an effective mixing of the substances and for a reduced amount of power required from an external power source.

Increasing the above-mentioned ratio above 10,000 results in too large a time interval for the mixing operation; on the other hand, a decrease of that ratio below 10 consumes more power since the storage capacitor must be charged to a rated value for a short time interval.

The following examples illustrate the preferred embodiments of the invention.

EXAMPLE 1

The method of the invention is used to mix liquid mixtures including motor oil and a liquid admixture, that serves to decrease the solidification temperature of the oil. The above-mentioned components are introduced into the reservoir of the apparatus according to the following percent ratio: 99 percent of motor oil and 1 percent of calcium alkylphenolate.

These substances are mixed when they are involved in a reciprocating movement provided by mechanical impulses along with the concurrent generation of mechanical impulses that are at right angles to said first-mentioned mechanical impulses.

The mechanical impulses have a duration of $10^{-3}$ s and a spacing of 1 s. The electric power accumulated is distributed in a manner that these mechanical impulses are generated.

The characteristics of the mixing operation are as follows:

time required for mixing, 25 s;

power taken from an external power source, 500 W; and energy consumed during the mixing operation, 4 W—h.

The method of the invention provides for an increased efficiency of the mixing operation, for a decreased mixing time, and for a reduced power taken from an external power source.

EXAMPLE 2

The method of the invention is used to mix loose substances with the result that a molding mixture is provided. The following components, according to a percent relation, are introduced into the apparatus reservoir: quartz sand, 60 percent; used mixture, 35 percent; clay, 3 percent; binding substance, which is an argillo-sulfide emulsion of peat pitch, 2 percent.

The substances are mixed by subjecting them to a reciprocating movement provided by mechanical impulses and by subjecting them to other mechanical impulses that are at right angles to the first-mentioned mechanical impulses, the two types of mechanical impulses are generated according to a given sequence. To generate a mechanical impulse belonging to the two above-mentioned types, the entire accumulated energy is consumed, with the result that the mechanical pulses produced have a greater intensity as compared to those of the previous example.

The characteristics of the mixing operation are as follows:

duration of mechanical impulses, $10^{-3}$ s;
spacing of mechanical impulses, 2 s;
mixing time, 60 s;
power take from external power source, 2.5 kW;
energy consumed during mixing operation, 45 W−h.

The method of the invention provides, in this case, for an increased efficiency of the mixing operation, for a decreased mixing time, and for a reduced power taken from an external power source.

The apparatus of the invention comprises a reservoir 1, as best shown in FIG. 1, having a side wall 2 and end walls 2', 2'' as well. One of the end walls 2' is rigidly fixed to the side wall 2, for example, by welding, and the other end wall 2' constitutes a lid of the reservoir 1. The lid 2'' is affixed to the side wall 2 using bolts 4 and substances 3 are charged through the lid 2'' into the reservoir 1. The inner side of the side wall 2 rigidly supports guide members 5 which accommodates a mixing means 6 in the form of a perforated disc. There are cradles 7 which project from the base of a frame 8 and they are used to support the reservoir 1. The frame 8 has two vertical walls 9, 10, the wall 9 being fixed immovably on the base of the frame 8, for example, by welding, and the wall 10 is longitudinally movable due to slots 11 provided in the base of the frame 8 and the wall 10 is fixed in place by bolts 12. The apparatus of the invention also comprises a reciprocating movement mechanism of the mixing means 6, which mechanism includes eddy current electromagnetic inductors 13, that are installed in close vicinity to the end walls 2' and 2'' of the reservoir 1, on respective vertical walls 9, 10, and they are coupled to a current source 14, and a turn-on sequencer 15 for the eddy current electromagnetic inductors 13. The reciprocating movement mechanism also includes elements 16 made of an electrically conductive material and arranged in the form of plates that are disposed between the inductors 13 and end walls 2' and 2'' of the reservoir 1. The inductors 13 are made in the form of several wire turns housed in a dielectric envelope, and are provided with power lead elements 17 which are used at the same time for mounting the inductors 13 on the walls 9, 10, the latter being used to accommodate dielectric inserts 18.

According to other embodiments of the invention, there may be two or more inductors 13 mounted on the walls 9, 10, which depends on the apparatus characteristics including its dimensions, on the substances being mixed, and on the other parameters.

The current source 14 comprises a storage capacitor 19 and a converter 20. Installed on the outer side of the side wall 2, on dielectric brackets 21, are three eddy current electromagnetic inductors 22 which are analogous to the inductors 13 and are connected in series to one another. According to other embodiments of the invention, any other number of the inductors 22 can be used, depending on the dimensions of the reservoir 1.

The inductors 22 are coupled to the current source 14 and in contact with elements 23 made of an electrically conductive material, which constitute plates disposed between the inductors 22 and the side wall of the reservoir 1. The turn-on sequencer 15 provides for the required sequence of turning-on of the inductors 22.

To increase the output of the inductors 13,22, the elements 16,23 must be made of a material offering a higher electric conductivity, for example, of copper or aluminium. There are shock-absorbing gaskets 24 which serve to resist impacts that may occur between the inductors 13 and the walls 9, 10 of the frame 8.

Figure 2:
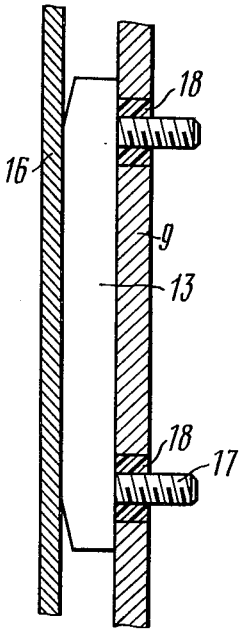
FIG. 2 is an enlarged, fragmentary view, in section of the element made of an electrically conductive material.

The end wall of the reservoir 1 (FIG. 2) can serve as the element 16.

Figure 3:
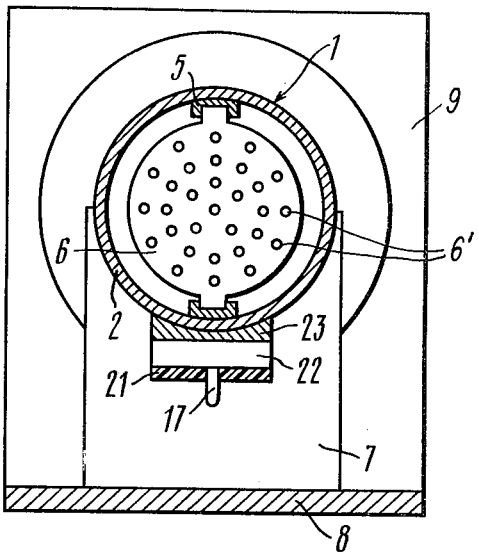
FIG. 3 is a sectional view taken along the line III—III of FIG. 1, illustrating the mixing means mounted on the guide members.

FIG. 3 is a sectional view taken along the line III—III of FIG. 1, illustrating the location of the mixing means in the guide members 5. The latter are used to maintain the mixing means 6 in parallelism with the end walls 2' and 2'' of the reservoir 1 as it moves from one end wall to another.

Figure 4:
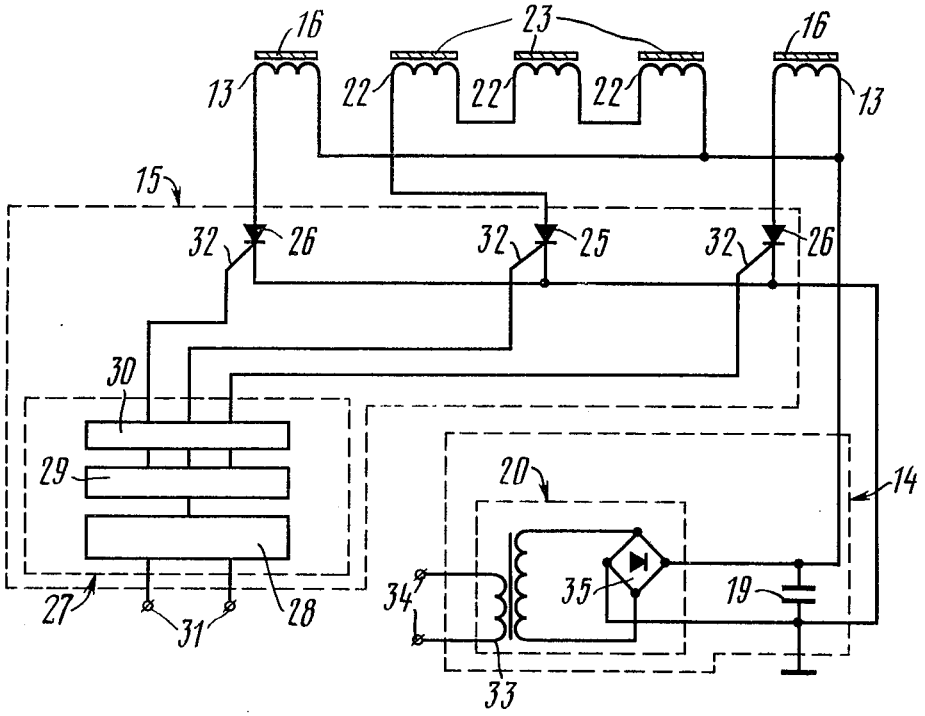
FIG. 4 is a connection diagram for the eddy current electromagnetic inductors, of the invention.

The turn-on sequencer 15 (FIG. 4) for the inductors 13, 22 comprises thyristors 25, 26 and a program switch 27 that includes a serial arrangement of a pulse generator 28, a ring-type shift register 29, and a pulse amplifier 30. The program switch 27 being connected to voltage supply terminals 31, and the gate electrodes 32 of the thyristors 25,26 being coupled to the program switch 27. The inductors 13, 22 are coupled to the current source 14 in the following manner. The group including three inductors 22, that are connected in series to one another, is coupled to the current source 14 via the thyristor 25, while the inductors 13 are coupled to the current source 14 through their respective thyristors 26.

The current source 14 comprises the storage capacitor 19 and the converter 20 that includes a step-up transformer 33 having its primary winding coupled to voltage supply terminals 34, and also includes a rectifier 35.

The apparatus of the invention operates in the following manner. The reservoir 1 (FIG. 1), whose side wall 2 mounts the inductors 22, is arranged vertically and the substances 3 to be mixed are introduced therein through its end wall 2'' which serves as the lid of the reservoir 1. In this case, the mixing means 6 is arranged on the other end wall 2' of the reservoir 1 so that a certain sequence is defined according to which the inductors 13 are turned on. After the substances 3 have been charged into the reservoir 1 the lid 2'' is closed tight using the bolts 4 and the reservoir 1 is installed on the cradles 7 so that its end wall 2' abuts against the shock-absorbing gaskets 24 on the vertical wall 9 of the frame 8. The movable wall 10 of the frame 8 is displaced to be in intimate contact with the end wall 2'' of the reservoir 1 so that the shock-absorbing gaskets 24 rest on said end wall 2'', and the wall 10 is then fixed in place using the bolts 12 so as to acquire a position in which the elements 18 touch the end walls 2' and 2'' of the reservoir 1. When it is impossible to provide for such a close relationship between the elements 16 and the end walls 2', 2'' of the reservoir 1 a clearance not exceeding 1.5 mm is permissible therebetween.

The establishment of contacting relation (or a minimum clearance) between the elements 16 and the end walls 2', 2'' of the reservoir 1 is a critical factor that influences effective operation of the inductors 13. Note that a similar contact should be attained between the side wall 2 of the reservoir 1 and the elements 23 in mounting the brackets 21 on the side wall 2.

The inductors 13, 22 are then connected electrically to the current source 14.

When the supply voltage is applied to the terminals 34 (FIG. 4) of the current source 14, the storage capacitor 19 charges via the step-up transformer 33 and the rectifier 35. At the same time, the supply voltage is applied to the terminals 31 of the program switch 27.

When a signal from the program switch 27 is applied to the gate electrodes 32 of any one of the thyristors 25, 26, or applied concurrently to the gate electrodes 32 of the thyristor 25 and of one of the thyristors 26, the respective thyristors are made conducting and the storage capacitor 19 is discharged via the inductors 13, 22. The program switch 27 operates to control the turning-on of the inductors 13, 22 according to a given sequence.

The pulse generator 28 produces a continuous train of voltage pulses which are delivered to the ring-type shift register 29 and are then amplified in the pulse amplifier 30.

Prior to operation, a logic 1 is placed in the first bit position of the shift register 29, while the remaining bit positions thereof receive logic 0's. The arrival of the first pulse from the pulse generator 28 makes the thyristors 25, 26, connected to the first bit position of the register 29, conducting, and the logic 1 is transferred to the second bit position; this means that the arrival of the second pulse from the pulse generator 28 causes the conduction state of the thyristors 23,26 connected to the second bit position of the register 29, and the logic 1 is transferred to the next bit position.

Let us now consider the operation of the apparatus of the invention, dealing with concurrent generation of the mechanical impulses at right angles to the reciprocating movement of the substances being mixed and the mechanical impulses providing said reciprocating movement. In this case, the program switch 27 operates to cause the conducting state of the thyristor 25 and one of the thyristors 26, with the result that the storage capacitor 19 is discharged via the group of inductors 22 (FIG. 1) and via one of the inductors 13. The first pulse causes concurrent operation of the inductors 22 and the inductor 13 which is installed near the end wall of the reservoir 1, which is 2' rigidly fixed to the side wall 2 of the reservoir 1. A current pulse passes over the turns of the inductor 13 and produces in the vicinity to the latter an alternating magnetic field pulse, with the result that eddy currents are induced in the element 18. The current passing through the turns of the inductor 13, interacts with the eddy current of the element 16 and the latter is therefore forced vigorously away from the inductor 13 which is rigidly fixed to the wall 9. The kinetic energy of the element 16 is transferred to the end wall of the reservoir 1, which rigidly attaches the side wall 2 of the reservoir 1, and said end wall 2' is subjected to elastic deformation. As a result, a contactless impact takes place on the end wall 2' of the reservoir 1. Since the mixing means 6 is in contact with the interior of the end wall of the reservoir 1 at that point in time, the end wall 2' transfers the mechanical impulse so created to the mixing means 6 and the latter therefore moves with a greater speed towards the other end wall 2'' of the reservoir 1 and drives in the course of its movement a portion of the substances 3 being mixed. The other portion of the substances 3 gets through the holes 6' in the mixing means 6 and is displaced towards the rigidly attached end wall 2'. The speed of the mixing means 6 reaches 30 m/s. Thus, the contactless mechanical impulse makes it possible to avoid a rigid coupling between the mixing means 6 and a drive, for example a pneumatic or electromagnetic one, installed outside of the reservoir 1, which coupling, if any, would reduce the effectiveness of transfer of the mechanical impulse since a considerable amount of the kinetic energy of the mixing means 6 would be consumed by that coupling.

The apparatus of the invention is also advantageous in that there is no device which provides for the introduction of that rigid coupling into the reservoir 1.

As the mixing means 6 moves, it is brought in intimate contact with the interior of that end wall 2'' of the reservoir 1 which serves as the lid of the reservoir.

At the moment when the mechanical impulse described above acts on the rigidly attached end wall 2', the inductors 21, analogous to the inductors 13, operate to act on the side wall 2 of the reservoir 1, with the result that the side wall 2 is subject to elastic deformation. The compression waves tend to propagate from the deformed locations into the bulk of the substances 3 being mixed, with the result that the latter are thrown up. As a result, the reciprocating movement of the substances 3 from one end wall to another and vice versa is accompanied by the movement of the substances 3 along a direction at right angles to the direction of the reciprocating movement, thereby providing for more effective mixing of the substances.

The first pulse is followed by a spacing within which the storage capacitor 19 stores the electric energy to be consumed during the next impulse. The storage capacitor 19 provides the power of the mechanical impulse which is tens to hundreds times as much as the power taken from an external power source, which results in an increased operational effectiveness of the apparatus of the invention and allows for a decrease in the power requirements.

After an elapse of said spacing, the program switch 27 (FIG. 4) causes concurrently the conduction of the thyristor 25 and the thyrsitor 26 which is coupled to the inductor 13 mounted near that end wall 2'' which serves as the lid of the reservoir 1. A process analogous to that described above therefore takes place and the mixing means 6 under the action of a mechanical impulse produced by the inductor 13 is moved towards the other end wall, thereby mixing the substances 3. At the same time, the substances 3 are thrown up under the action of another mechanical impulse provided by the inductors 22 and applied to the side wall 2 of the reservoir 1.

After that, a spacing is provided and the operation cycle is repeated.

As stated above, the mechanical impulses at right angles to said reciprocating movement of the substances 3 are generated during the spacings between those mechanical impulses which provide for the reciprocating movement. In this mode of operation, the turn-on sequencer 15 is operated to serially activate the inductor 13 on the vertical wall 9 of the frame 8, the group of the inductors 22 on the side wall 2, and the inductor 13 on the vertical wall 10 of the frame 8. The operation cycle is terminated at the moment when the group of the inductors 22 on the side wall 2 is activated again.

The turning-on of each of the inductors 13 and of the group of the inductors 22 is followed by a spacing during which the energy for the next mechanical impulse is stored.

In the case of the operating mode dealing with sequential generation of the mechanical impulse providing for the reciprocating movement of the substances and of the mechanical impulses at right angles to said reciprocating movement, the turn-on sequencer 15 turns on serially the inductor 13 on the vertical wall 10 of the frame 8 and the group of the inductors 22 on the side wall 2 of the reservoir 1. The activation of the inductors 13, 22 results in the occurrence of the processes described above.

After each of the inductors 13 and the group of the inductors 22 has been turned off, a spacing is provided during which the energy for the next pulse is stored.

The apparatus of the invention also operates in a pulsed mode. The duration of a mechanical impulse is determined by the time interval for which the currents within the turns of the inductors 13, 22 are present and interact with the current induced in the elements 16, 23. The above-mentioned duration can be adjusted by varying the charge time of the storage capacitor 19 and determines the amplitude of the mechanical impulse. That amplitude must be of a value sufficient for the mixing means 6 to move rapidly to the opposite end wall of the reservoir 1 and for the substances 3 to be thrown up when the side wall 2 of the reservoir 1 is influenced by the inductors 22. Note that in this case the stresses occurred within the walls of the reservoir 1 should not exceed the value of the cyclic strength of the material. This means that the duration of a mechanical impulse must amount to 0.001–0.25 of the period of the inherent oscillations of the construction. Since the advanced constructions offer a stiffness at which the frequency of the inherent oscillations is at a level of not less than 30 Hz, the duration of a mechanical impulse will be of an order of 10–5 to 1–2 seconds.

The apparatus and method of the invention therefore provide for an effective mixing of substances, with the result that a higher labor productivity is attained along with a considerable reduction of the power taken from an external power source.

Although the present invention has been described in some detail by way of illustration and example for purposes of clarity of understanding, it will, of course, being understood that various changes and modifications may be made in the form, details, and arrangements of the parts without departing from the scope of the invention as set forth in the following claims.

What is claimed is:

1. An apparatus for mixing substances, comprising:

a reservoir having end walls and a side wall;

a mixing means disposed within said reservoir;

a reciprocating movement mechanism of said mixing means;

a current source, having a storage capacitor, of said reciprocating movement mechanism;

eddy current electromagnetic inductors of said reciprocating movement mechanism, disposed in immediate proximity to said end walls of said reservoir and coupled to said current source;

a turn-on sequencer for said eddy current electromagnetic inductors; and elements of said reciprocating movement mechanism, made of an electrically conductive material being disposed in intimate contact with said eddy current electromagnetic inductors.

2. An apparatus for mixing substances as claimed in claim 1, including:

a program switch; and said turn-on sequencer including a plurality of thyristors that have their gate electrodes coupled to said program switch.

3. An apparatus as claimed in claim 1, wherein:

said elements made of an electrically conductive material are disposed between respective eddy current electromagnetic inductors and said corresponding end walls of said reservoir.

4. An apparatus as claimed in claim 1, including additional elements made of an electrically conductive material provided by said side walls of said reservoir.

5. An apparatus as claimed in claim 4, including additional eddy current electromagnetic inductors disposed on said side wall of said reservoir, connected in series with one another and coupled to said current source; and said additional elements made of an electrically conductive material are disposed between said side wall and said reservoir and said additional eddy current electromagnetic inductors.

6. An apparatus as claimed in claim 2, wherein said elements of said reciprocating movement mechanism, made of an electrically conductive material are disposed between respective eddy current electromagnetic inductors and said corresponding end walls of said reservoir.

7. An apparatus as claimed in claim 2, wherein said elements of said reciprocating movement mechanism, made of an electrically conductive material are provided by said end walls of said reservoir.

8. An apparatus as claimed in claim 2, wherein an additional eddy current electromagnetic inductors are disposed on said side wall of said reservoir, and are connected in series with one another and coupled to said current source; and said additional elements made of an electrically conductive material are disposed between said side wall of said reservoir and said additional eddy current electromagnetic inductors.

9. An apparatus as claimed in claim 6, wherein additional eddy current electromagnetic inductors are disposed on said side wall of said reservoir, and are connected in series with one another and coupled to said current source; and said additional elements made of an electrically conductive material and are disposed between said side wall of said reservoir and said additional eddy current electromagnetic inductors.

10. An apparatus as claimed in claim 7, wherein additional eddy current electromagnetic inductors are disposed on said side wall of said reservoir, and are connected in series with one another and coupled to said current source; and said additional elements made of an electrically conductive material, are disposed between said side wall of said reservoir and said additional eddy current electromagnetic inductors.

11. A method of mixing substances comprising subjecting the substances to be mixed to mechanical impulses that are directed in two different directions, with one of said impulses imparting a reciprocating movement to the substances.

12. A method as claimed in claim 1, wherein one of said mechanical impulses having a duration ranging from $10^{-5}$ to $10^{-2}$ s, the ratio between the spacing of the mechanical impulses and their duration amounting to a range of 10 to 10,000.

13. A method as claimed in claim 1, wherein the mechanical impulses that are at right angles to said reciprocating movement of the substances being mixed occur simultaneously with said mechanical impulses providing for said reciprocating movement of the substances being mixed.

14. A method as claimed in claim 1, wherein the mechanical impulses that are at right angles to said reciprocating movement of the substances being mixed occur during the spacings between the mechanical impulses providing for said reciprocating movement of the substances being mixed.

15. A method as claimed in claim 11, comprising a sequential generation of the mechanical impulses providing for said reciprocating movement of the substances being mixed and of the mechanical impulses at right angles to said reciprocating movement of the substances being mixed.

16. A method as claimed in claim 13, wherein said mechanical impulses having a duration ranging from $10^{-5}$ to $10^{-2}$ s, the ratio between the spacing of the mechanical impulses and their duration amounting to a range of 10 to 10,000.

17. A method as claimed in claim 14, wherein said mechanical impulses having a duration ranging from $10^{-5}$ to $10^{-2}$ s, the ratio between the spacing of the mechanical impulses and their duration amounting to a range of 10 to 10,000.

18. A method as claimed in claim 15, wherein said mechanical impulses having a duration ranging from $10^{-5}$ to $10^{-2}$s, the ratio between the spacing of the mechanical impulses and their duration amounting to a range of 10 to 10,000.

19. A method as claimed in claim 11, wherein said mechanical impulses are in two mutually perpendicular directions.

20. A method as claimed in claim 19, wherein one of said directions is at a right angle to said reciprocating motion of the substances.

* * * * *